US006170139B1

(12) United States Patent
Lotz

(10) Patent No.: US 6,170,139 B1
(45) Date of Patent: Jan. 9, 2001

(54) DEBURRER FOR BILLETS AND SLABS FOR USE IN CONTINUOUS STEEL CASTING PLANTS

(75) Inventor: Horst K. Lotz, Hofheim-Wallau (DE)

(73) Assignee: Gega Corporation, Pittsburgh, PA (US)

( * ) Notice: Under 35 U.S.C. 154(b), the term of this patent shall be extended for 0 days.

(21) Appl. No.: 09/229,908

(22) Filed: Jan. 13, 1999

(30) Foreign Application Priority Data

Feb. 6, 1998 (EP) ..... 98102037

(51) Int. Cl.[7] ..... B23P 23/04; B21D 31/06; B23D 1/22

(52) U.S. Cl. ..... 29/33 A; 72/76; 164/263; 409/300; 409/301

(58) Field of Search ..... 29/33 A, 33 C, 29/81.05, 526.4, 81.15; 22/71, 76; 409/297, 298, 300, 301, 303; 164/263

(56) References Cited

U.S. PATENT DOCUMENTS

| | | | | |
|---|---|---|---|---|
| 2,521,199 | | 9/1950 | Babcock . | |
| 3,377,896 | | 4/1968 | de Corta . | |
| 3,515,029 | | 6/1970 | Gambini . | |
| 4,357,817 | * | 11/1982 | Linsinger | 409/301 X |
| 4,362,448 | | 12/1982 | Hasebe et al. . | |
| 4,672,726 | * | 6/1987 | Delbecq et al. | 29/33 A |
| 4,704,241 | | 11/1987 | Boggs . | |
| 5,179,772 | * | 1/1993 | Braun et al. | 29/33 A X |
| 5,253,398 | * | 10/1993 | Markiewicz | 29/33 A |
| 5,259,440 | | 11/1993 | Lotz et al. . | |
| 5,597,030 | | 1/1997 | Lotz et al. . | |
| 5,626,181 | * | 5/1997 | Lotz et al. | 409/303 X |
| 5,765,271 | * | 6/1998 | Lotz et al. | 29/33 A |

FOREIGN PATENT DOCUMENTS

| | | |
|---|---|---|
| 0 463 201 A1 | 6/1990 | (EP) . |
| 0 671 230 B1 | 3/1994 | (EP) . |
| 56-21712 | 2/1981 | (JP) . |
| 58-71022 | 4/1983 | (JP) . |
| 3210951 | 9/1991 | (JP) . |
| 1389946 | 12/1985 | (SU) . |

* cited by examiner

*Primary Examiner*—William Briggs
(74) *Attorney, Agent, or Firm*—Alan G. Towner; Brij K. Agarwal; Eckert Seamans Cherin & Mellott, LLC

(57) ABSTRACT

In this application for protection rights a new deburrer is presented, in which the deburring device working on a slab (1) or a billet (1), as a stationary design moves the work piece with an integrated pusher drive or includes a pusher drive when designed as a travelling device.

12 Claims, 8 Drawing Sheets

DEBURRER FOR BILLETS AND SLABS FOR USE IN CONTINUOUS STEEL CASTING PLANTS

BACKGROUND INFORMATION

When thermo-cutting with oxygen, especially in continuous steel casting plants, on both the lower edges of the oxy-cut, i.e. at the beginning and at the end of each cut off work piece, more or less big burrs consisting of a mix of brittle iron oxide and hard to soft steel are developping by the down flowing and partly freezing cutting slag. Partly these beards hang deeply down from the edges like icicles, partly relatively flat bulges are forming at the edge neighbouring areas of the lower work piece surfaces, partly any shape and size of same in combination. They all depend on the material composition, material temperature and chemophysical working data of the cutting tools. On any rate the existence of this burrs gives trouble for further processing if not already in transport.

It would be desirable to avoid such cutting burrs, buth this cannot be realized. A substantial reduction is possible under circumstances, but the beard cannot be defined in its size from the beginning and is not accepted without later improvements under all circumstances.

Therefore, there is a series of working ways and processes, to remove the burr soonest after the oxy-cutting, as there are by melting down, burning off or flame scarfing with a hand-held oxygen burner; by melting down, burning-off or flame scarfing with an oxygen burning machine; by knocking or chiseling off by hand; by knocking off, pushing off, shearing off using machines, equipped with hammer-like, chisel-like or shearing-blade-type tools.

Whereas the flame-technical deburring methods have the advantage of high deburring speeds, they are very disadvantageous due to smoke formation, slag splashing, granulation water requirement and fire or explosion hazard. Therefore the need turns more to the mechanical deburring possibilities, for which apart from the expenditure for mechanical equipment and energy only the considerable time requirement and the discharging of the loose beards is to be considered.

Correspondingly advantageous deburrers for mechanical deburring of cutting burrs have been already suggested in the EP-A-0 463 201 and in the EP-A-94 10 3765. Meanwhile the deburrers following above mentioned applications have proven themselves successful in practical use by better deburring rates, low noise and less requirement for positioning.

Disadvantageous remain with respect to the expenses for short and low weight work pieces and space requirement in multi-strand billet casters. Of course this demands as well less maintenance requirements.

The biggest expenditure lies with the deburrers for slabs and blooms of short length and low weight.

For short ones the gaps in support are too short for the travel of deburrers, low weight work pieces call for holding and shifting devices, as their friction on the support neither gives sufficient holding forces for the travelling deburrers not sufficient deburring forces for travelling work piece deburring.

As long as a 100% deburring rate is not yet achieved, the task to improve the system or the design, especially that of the deburrer chisels is still exists.

Therefore the task arises, to manufacture stationary deburrers with pushing equipment and travelling deburrers as well for short deburring gaps at low cost and with still better deburring rate.

DETAILED DESCRIPTION

The solution of this task is that the pusher drive for the deburring motion of the work piece or the pusher drive moving the carriage of the deburrer form a unit with the deburrer or with the carriage of the deburrer respectively, which realize two functions: shifting and deburring; travelling and deburring =pusher drive deburrer.

As occasionally billets and slabs with top side lying cutting burr have to be cleaned of the latter, these pusher drive deburrers can as well be applied advantageously as hanging units.

Figure 1:
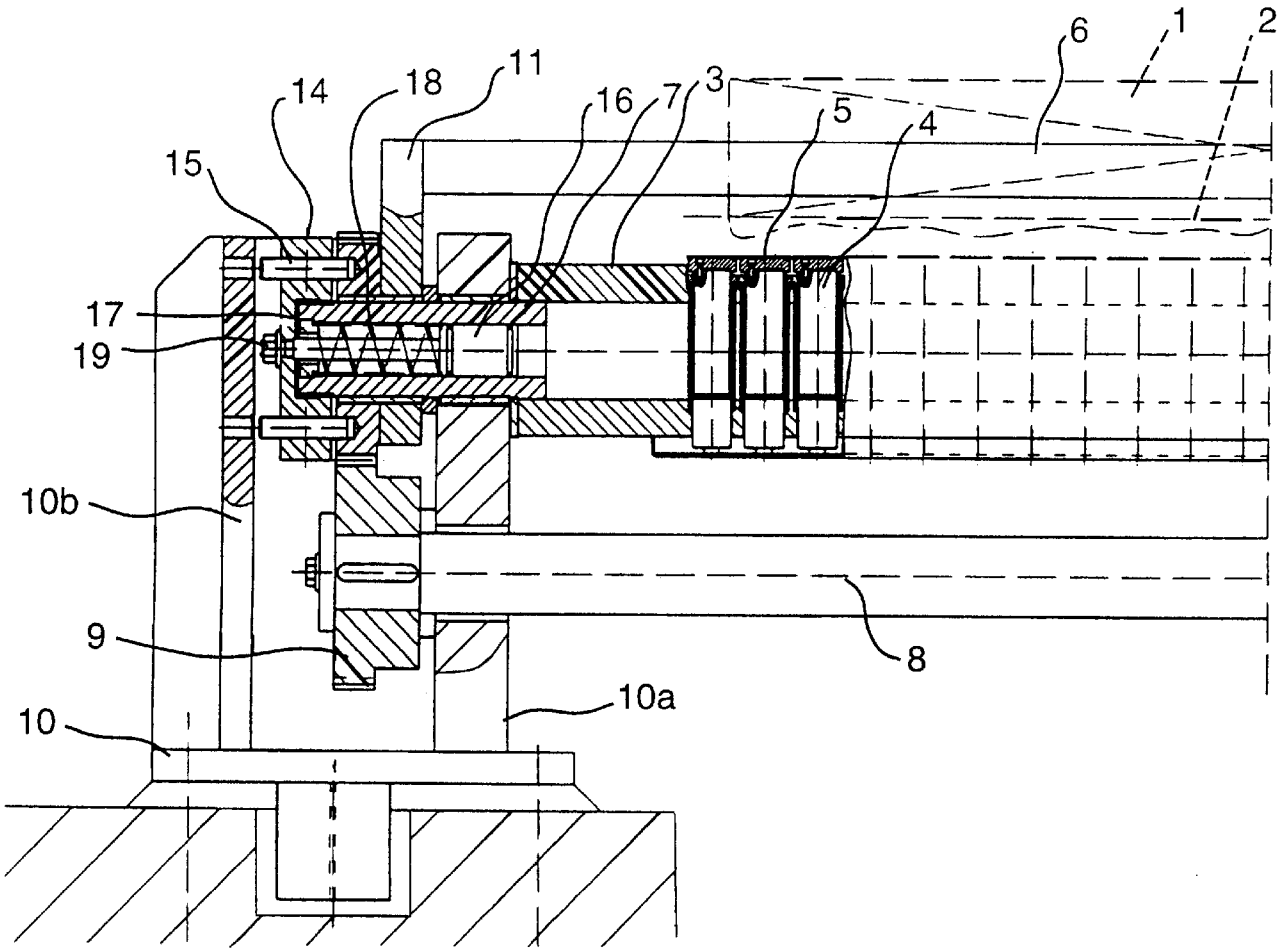
FIG. 1 is a front elevational view, partially cut away, of a deburrer in accordance with the present invention.
Figure 2B:
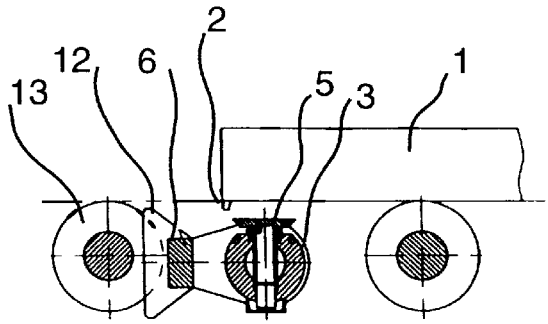
FIG. 2B is a sectional view as taken along line 2B—2B of FIG. 2A.
Figure 2A:
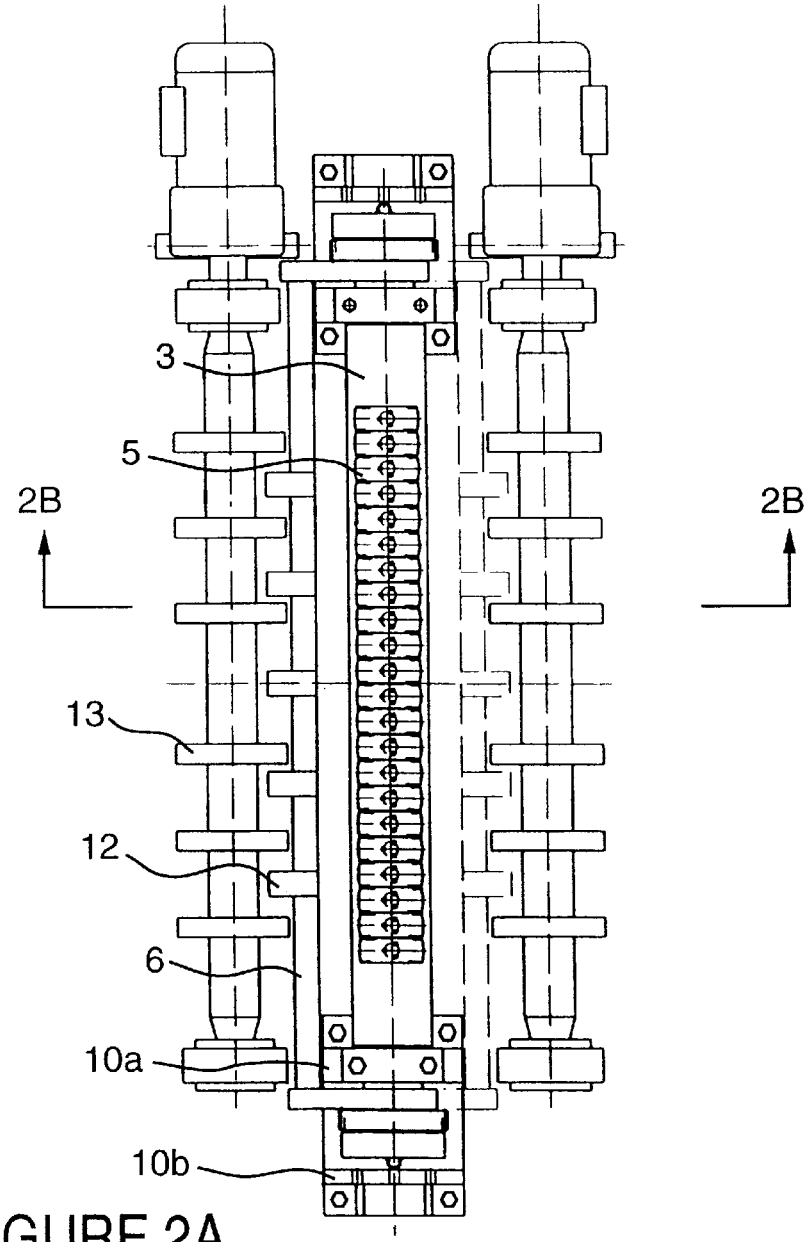
FIG. 2A is a top plan view of a portion of the deburrer.

As shown in FIG. 1, the pusher bar (6) sitting on the axle stubs (7) of the deburrer body (3), driving the slab (1) with its burr (2) over the deburrer body (3) with its compressed air actuated deburrer pistons (4) and their deburrer chisels (5), whereby the action and reaction forces of the deburring balance themselves near their location of origin, when the pusher bar (6) driven by a not shown motor via shaft (8) with a gear (9)—both supported in frame (10) and engaged in the geared lower part of the pusher lever (11)—moves the slab (1) across the deburrer chisel In accordance with FIGS. 2A and 2B, the pusher bar (6) can be elongated by so named pusher plates (12), which increase the length of the pusher bar (6) if the supporting rollers (13) are arranged near to the deburrer because of the shortness of slabs. Then it is possible to contact the slab (1) further up on its front face, even partly above it, to avoid a lifting of a short slab (1) by a force component at the pusher bar (6) moving in an arc. For this the pusher plates (12) have to be shaped regressing inclined and the neighbouring support rollers (13) must be designed as disk rollers, into which the pusher plates (12) will reach.

Figure 3A:
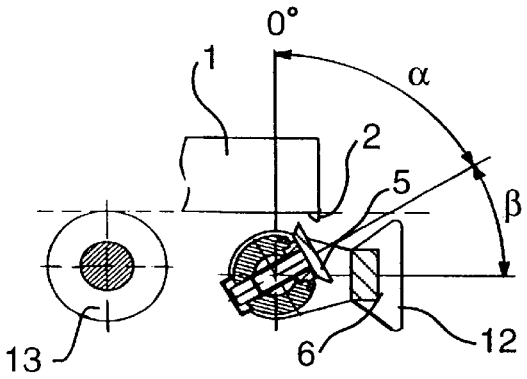
FIG. 3A is a side elevational view of a portion of the deburrer in a first position with respect to a slab.
Figure 3D:
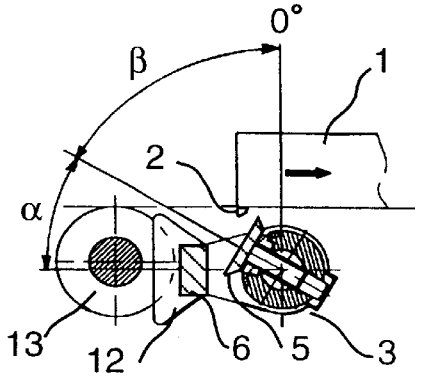
FIG. 3D is a view similar to FIG. 3C, except showing the deburrer in a fourth position with respect to the slab.

In FIGS. 3A–3F it is shown that it is advantageous to operate the deburrer body (3) of the deburrer and its pusher bar (6) in related steps one after another from and into certain positions using a common drive and eventually an additional clutch. FIG. 3A shows the slab (1) with its first burr (2) in run-out direction above the deburrer in O-position. Pusher bar (6) and deburrer body (3) with the deburrer chisels (5) are rotated away with the run-out direction by the angles $\alpha$ plus $\beta$ respectively $\beta$. The common drive moves the pusher bar (6) and the piston body (3) to the left by an angle $\beta$, whereby the pusher bar (6) arrives in a position angle $\alpha$ in front of the slab, and the deburrer body under the slab (1). Now the deburrer chisel (5) is lifted up against the slab (1) right behind the burr (2).

Figure 3B:
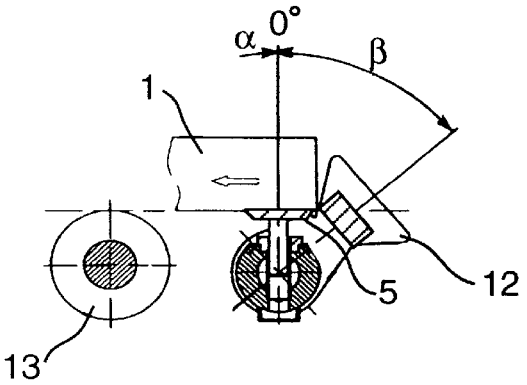
FIG. 3B is a view similar to FIG. 3A, except showing the deburrer in a second position with respect to the slab.
Figure 3E:
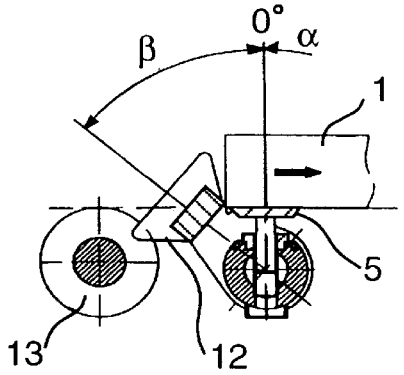
FIG. 3E is a view similar to FIG. 3D, except showing the deburrer in a fifth position with respect to the slab immediately prior to the removal of a second burr from the slab.

The situation shown in FIG. 3B=starting position is reached.

Figure 3C:
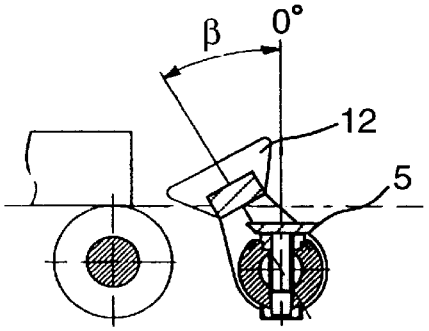
FIG. 3C is a view similar to FIG. 3B, except showing the deburrer in a third position with respect to the slab and with a first burr having been removed from the slab.
Figure 3F:
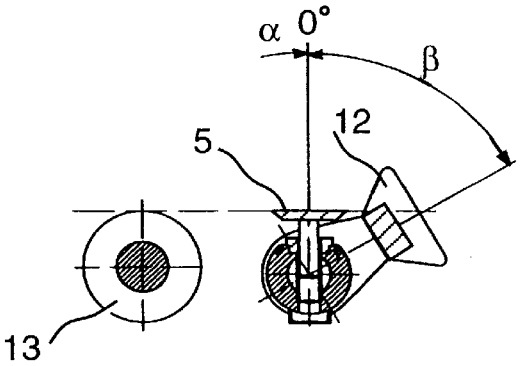
FIG. 3F is a view similar to FIG. 3E, except showing the deburrer in a sixth position on its return to the position depicted generally in FIG. 3A.

From this the pusher bar (6) pushes the slab (1) across the deburrer chisels (5) with its stationary deburrer body (3) and thus pushing the burr (2) off, moving into the situation depected in FIG. 3C.

The pusher bar (6) travels now again together with the deburrer body (3) into the second O-position (FIG. 3D) for the second burr (2), the deburrer chisel (5) is during this retracted. Then the slab (1) travels forward in run-out direction into its second burr (2) according to situation the situation depicted in FIG. 3E into its deburring position corresponding to the O-position situation depicted in FIG. 3A.

After the pusher bar (6) and the deburrer body (3) have rotated into starting position and the deburrer chisels are lifted, the second burr (2) can be removed as before. After the complete deburring the slab will be run-out.

An especially advantageous design of the pusher drive deburrer is shown in FIG. 1. Here the agent compressed air required for pushing the deburring deburrer (4) with deburrer chisel (5) out is as well used for fixing the piston body (3).

Described in detail, the deburrer body (3) has two axle stubs (7), supported in bearings in an inner frame (10*a*), carrying then the bar lever (11) of the pusher bar (6) and having a multi key profil for a shiftable cam disk (14) equipped with cams (15).

In the interior of the axle stubs (7) which serve as cylinders in a piston (16), which shifts and fixes the cam disk (14) with its cams (15) into the corresponding ones of the pusher lever (11) using a spring (18) in a spring sleeve (17) via a nut (19), so that it can rotate the deburrer body (3) via gear (9) and shaft (8), which is also supported in the inner frame (10*a*). When compressed air is flowing into the deburrer pistons (3) to lift the deburrer body (4), then the piston (16) moves with its step on the piston rod (26) the cam disk (14) with its cams (15) into the accordingly drilled outer frame (10*b*) and fixes the deburrer body (3) in this position as well if the pusher bar (6) continues to rotate. When the compressed air is flowing out not only the deburrer pistons (4) with the deburrer chisels drop, but the deburrer (16) will be pushed back by the spring (17) and disengages the piston body (3) from the outer frame (10*b*) and at the same time connected with the pusher bar (6) for further rotation. Thus the necessary synchronous rotations, the fixing, the on-ward rotation and the common on-rotation with the corresponding pushing-in and out of the cam disk (14) to and from the pusher bar (6) and deburrer body (3) to and in the equivalent situations are safely possible with a minimum of cost.

With soft and tough, additionally warm cutting beards (2) it happens, that separated narrow strips of this beards (2) intrude into wedge-like openings between the adjacent surfaces (31) of the deburrer chisels (5) at higher deburring speeds and jam there and prevent a safe contact of the latter to the slab (1) surface during the next deburring process and prevent a proper deburring in the area of this two deburrer chisels (5).

Figure 4B:
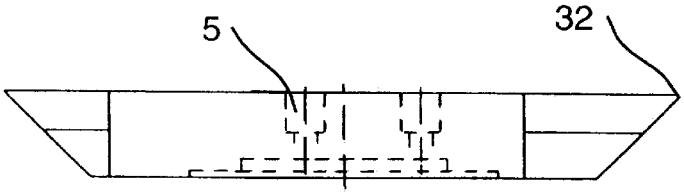
FIG. 4B is a side elevational view of a deburring chisel according to the first configuration.
Figure 4C:
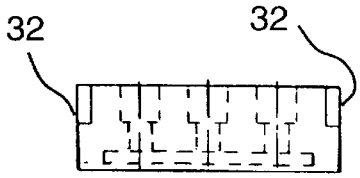
FIG. 4C is an end elevational view of a deburring chisel according to the first configuration.
Figure 4A:
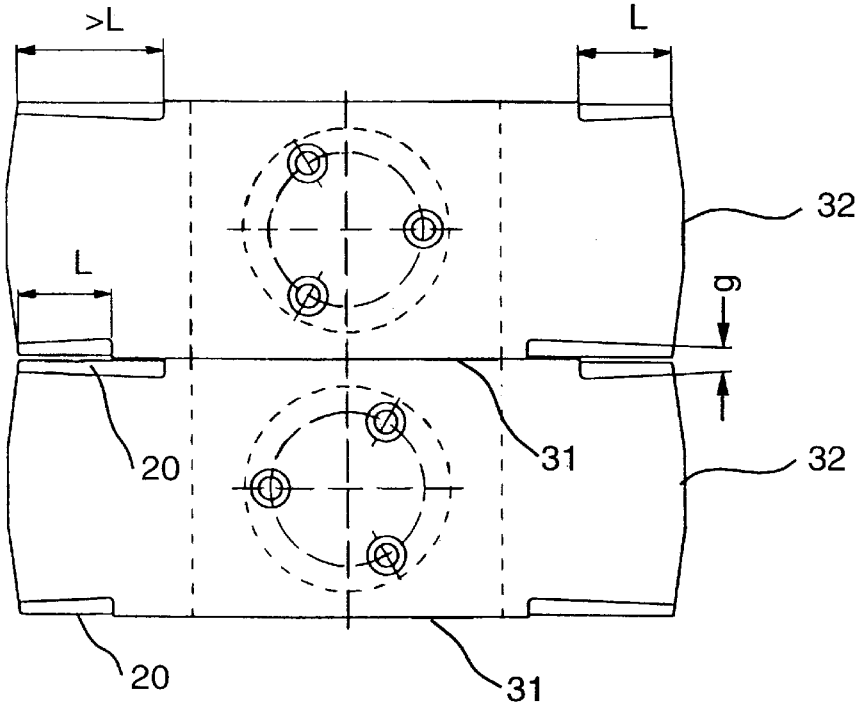
FIG. 4A is a top plan view of a pair of deburring chisels according to a first configuration.

A deburring chisel (5) as shown in FIGS. 4A–4C has recessed steps behind its cutting edges (32) at its adjacent faces (31) of different lengths, but at least as long in longitudinal direction of the slab as the burr (2) to be eliminated. These recesses are called chip grooves (20) and widen when going inside the deburrer chisel at least to an angle $\gamma$, which develops by opposition rotation of neighbouring chisels (5). In vertical direction the chip grooves (20) should be inclined against the adjacent faces (31) in order to avoid that an intruding piece of burr (2) does not only not jam, but also falls possibly out when the neighbouring deburrer chisels lift and lower not synchronously.

Figure 5A:
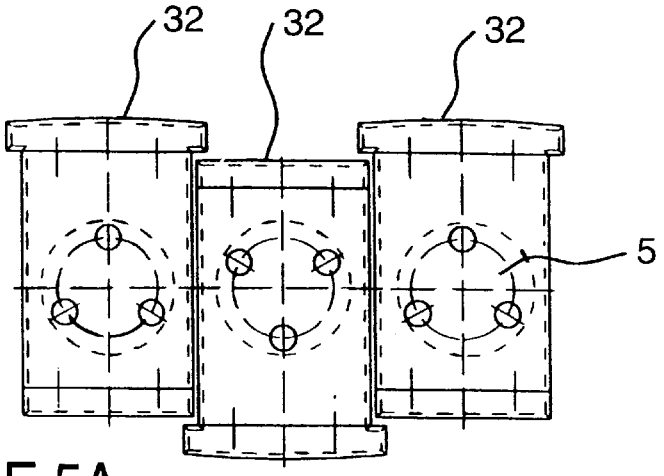
FIG. 5A is a top plan view of three deburring chisels according to a second configuration.
Figure 5B:
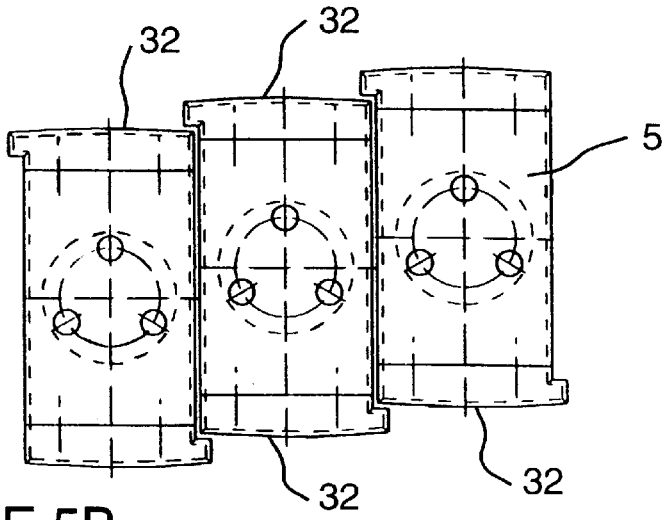
FIG. 5B is a top plan view of three deburring chisels according to a third configuration.
Figure 5C:
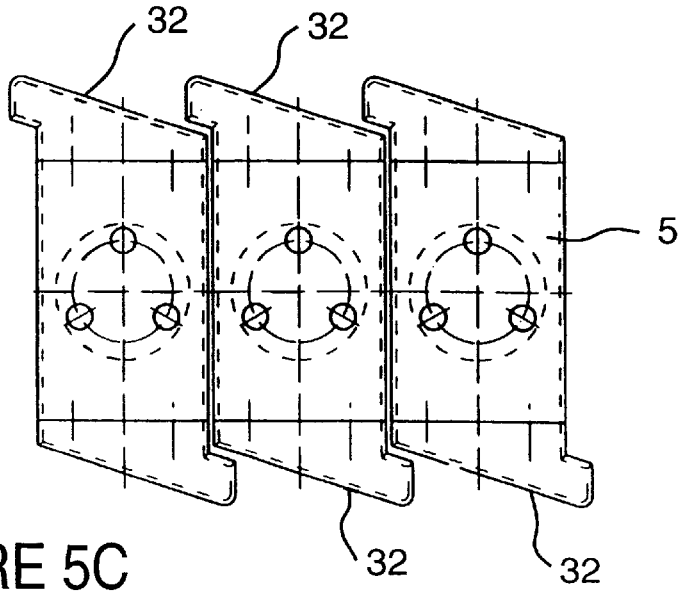
FIG. 5C is a top plan view of three deburring chisels according to a fourth configuration.

Even more advantageous appear to be the shapes of the deburrer chisels (5) shown in FIGS. 5A–5C, where a little piece of the one cutting edge (32) of the one deburrer chisel (5) overlapps the cutting edge (32) of the neighbouring deburrer chisel (5), i.e. one working in front of the other. In this way a unwanted wedge-shaped gap between two deburrer chisels (5) cannot develop. This shapes can ce produced and used as periodically arranged T- or as continuously arranged Z-design.

Figure 6:
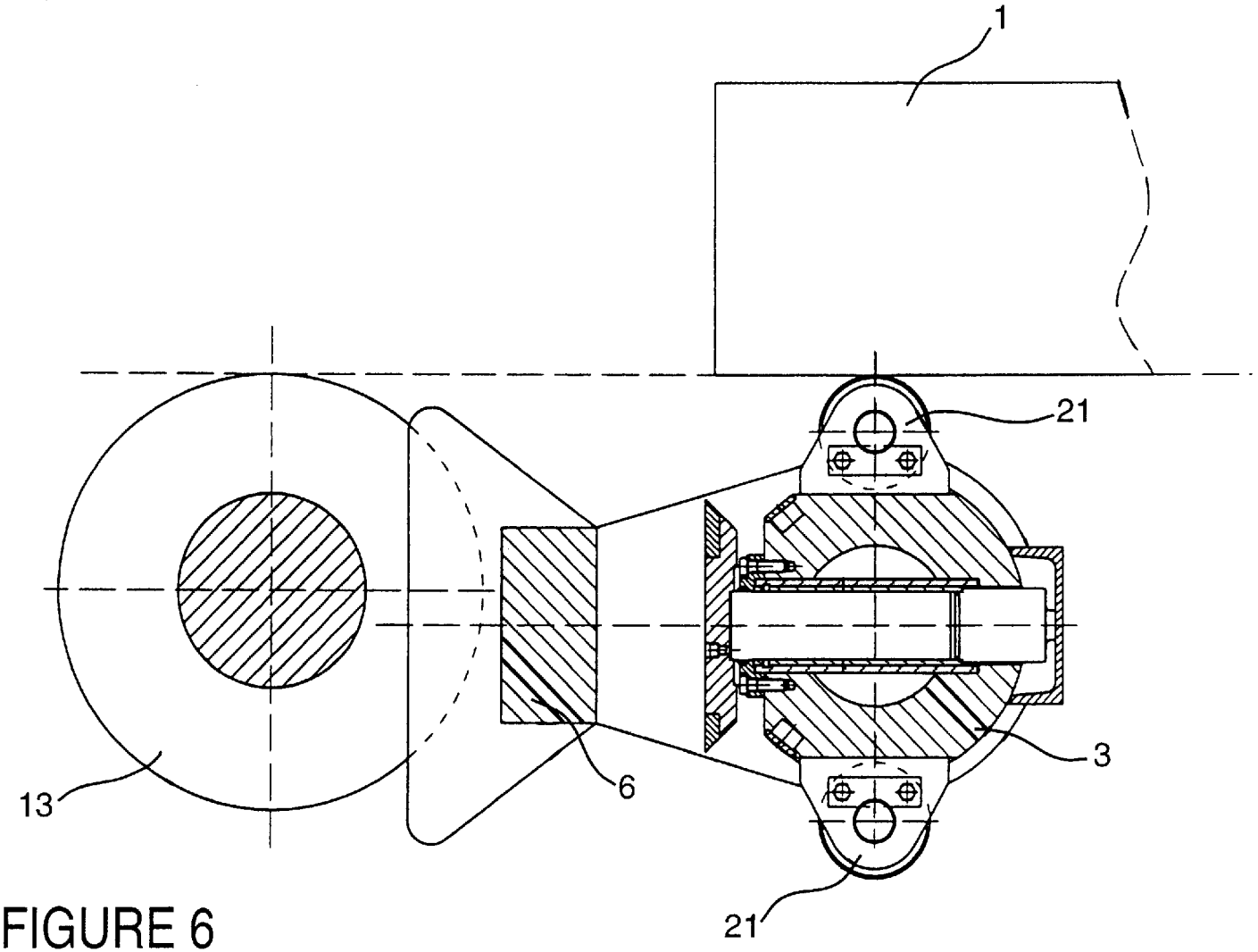
FIG. 6 is a side elevational view, partially cut away, of a portion of a second embodiment of the deburrer of the present invention incorporating a piston body having a pair of support rollers mounted thereon.

In FIG. 6 a pusher drive deburrer as described before is suggested, which can deburr extremely short slabs, because before and after it supporting rolls (13) with disks are positioned and the deburrer body (3) has on its sides roller bearing support rollers (21) which are on top in the O-positions or final positions of the deburrer body (3) and avoid a down-tilting of the short slabs (1) travelling over them. Otherwise these support rollers (21) hide in the gaps between the disks of the main support rollers (13).

The different situations depicted in FIGS. 3A–3E of the working procedure during deburring and the respective angle positions for control of interlocking and lock releasing may be controlled.

The following or approximate angle positions are especially advantageous.

| | | | | |
|---|---|---|---|---|
| O-position | pusher bow (6) | 90 degree | piston body (3) | 60 degree |
| Starting position | pusher bow (6) | 30 degree | piston body (3) | 0/360 degree |
| End of deburring | pusher bow (6) | 330 degree | piston body (3) | 0/360 degree |
| Final position | pusher bow (6) | 270 degree | piston body (3) | 300 degree |

When deburring the first, that means the front cutting beard (2) in travel direction the same positions are considered but in inverse direction. That means that the two parts between 270 and 330 as well as between 30 and 90° related to the pusher bar (6) are linked, once with the deburrer body (3) at 30° before and once behind. Between them the deburrer body (3) is interlocked with the outer frame **(10*b*)** at 360°.

Figure 7:
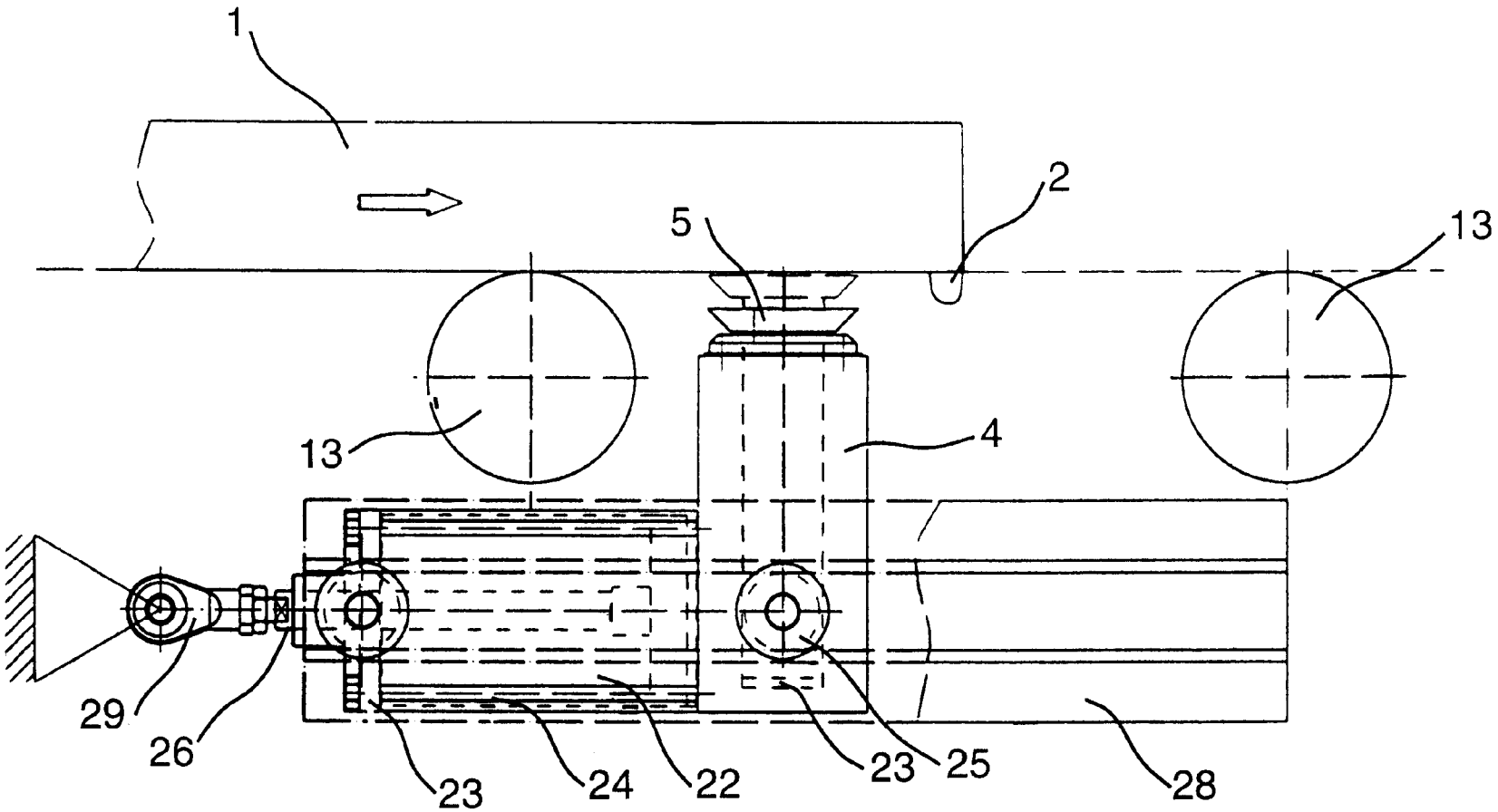
FIG. 7 is a side elevational view, partially cut away, of a third embodiment of a deburrer in accordance with the present invention.

In FIG. 7 a deburrer whose pusher drive, composed of cylinder (22), cylinder cover (23), tension rods (24) holding together the latter and not visible pistons with piston rod (26), carries as well a piston body—the one here being realized as unit with a cylinder cover (23)—with the deburrer piston (4) and the respective deburrer chisel (5) as it travels with travelling wheels (25) in tracks (28). Thereby the travelling wheels (25) can be supported in the cylinder covers (23).

In order to achieve a best possible use of the available gap between the support rollers (13) the piston head (29) is linked below these support rollers (13) for the billet (1).

Figure 8A:
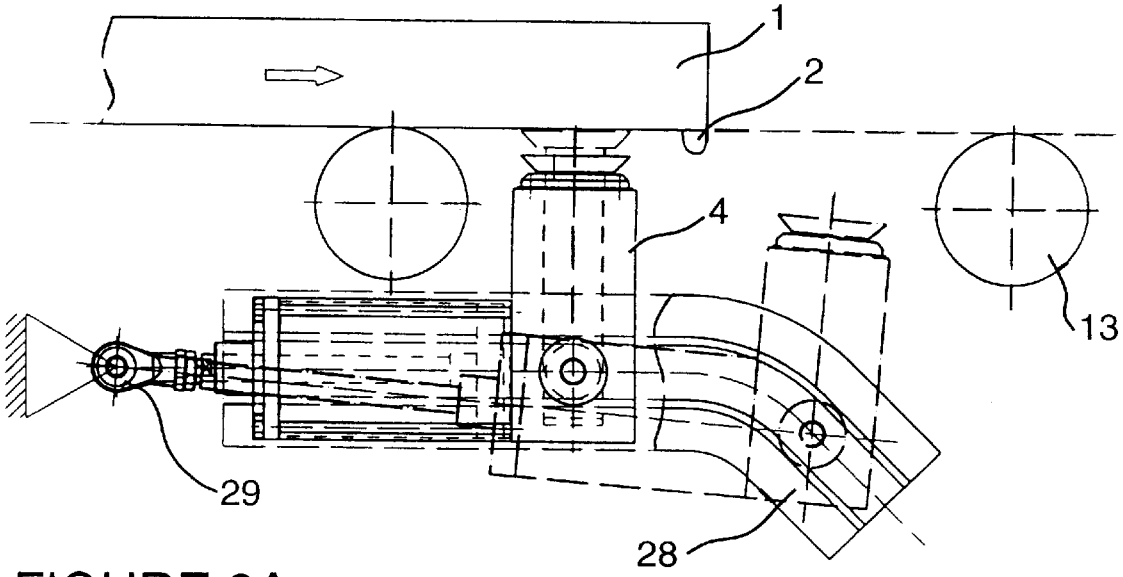
FIG. 8A is a side elevational view, partially cut away, of a fourth embodiment of a deburrer in accordance with the present invention.
Figure 8B:
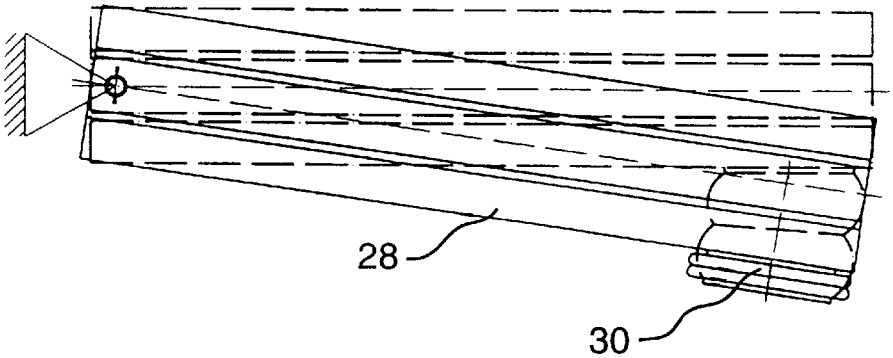
FIG. 8B is a side elevational view of a track that is used in conjunction with a fifth embodiment of the deburrer of the present invention.

As shown in FIGS. 8A and 8B a such composed deburrer can be lowered in downward bent tracks (28) or such with lowering cylinders (30) outside the deburring procedure in order to increase the operational safety.

What is claimed is:

1. Deburrer for subdivided continuously cast billets and slabs, the deburrer comprising:

a deburrer body supporting a plurality of deburrer pistons in deburrer cylinders;

a pusher bar mounted adjacent the deburrer body; and a plurality of deburring chisels mounted on the deburrer pistons, wherein the deburring chisels comprise recesses of adjacent deburring chisel faces adjacent near cutting edges of the deburring chisels, or comprise overlapping cutting edges arranged such that the cutting edge of each deburring chisel overlaps the cutting edge of the next adjacent deburring chisel.

2. The deburrer according to claim 1, wherein the deburrer is positioned above the billets or slabs to remove top burrs from the billets or slabs.

3. The deburrer according to claim 1, wherein the pusher bar is rotatable around an axis of the deburrer body.

4. The deburrer according to claim 1, comprising push plates mounted outside of the pusher bar which fit into gaps between disks of a front roller and a following roller to support the billets or slabs.

5. The deburrer according to claim 1, comprising a common drive for the pusher bar and the deburrer body for positioning and deburring the billets or slabs.

6. The deburrer according to claim 5, comprising clutch members arranged on the deburrer body for selectively engaging the pusher bar.

7. The deburrer according to claim 1, wherein the recesses of the adjacent deburrer chisels comprise angled chip grooves.

8. The deburrer according to claim 1, wherein the deburrer chisels overlap each other to form a T or a Z configuration.

9. The deburrer according to claim 1, comprising supporting rolls near the deburrer which fit into gaps between disks of a front roller and a following roller to support the billets or slabs.

10. The deburrer according to claim 1, wherein the deburrer body is rotatable to predetermined angular positions.

11. The deburrer according to claim 1, comprising a moveable cylinder connected to the deburrer body mounted on wheels which travel in rails below or above the billets or slabs.

12. The deburrer according to claim 11, wherein portions of the rails are bent downward or upward to retract the deburrer away from the billets or slabs after they have been deburred.

* * * * *

UNITED STATES PATENT AND TRADEMARK OFFICE

CERTIFICATE OF CORRECTION

PATENT NO. : 6,170,139 B1
DATED : January 9, 2001
INVENTOR(S) : Horst K. Lotz

It is certified that error appears in the above-identified patent and that said Letters Patent is hereby corrected as shown below:

Column 1,
Line 20, "buth" should be -- but --.
Line 50, "Disadvantageous" should be -- Disdavantages --.
Line 65, "is" should be deleted.

Column 2,
Line 43, "," should be -- ; --.
Line 61, "=pusher" should be -- = pusher --.

Column 3,
Line 8, after "chisel" -- (5) -- should be inserted.
Line 29, "piston" should be -- deburrer --.
Line 34, "3B=starting" should be -- 3B = starting --.
Line 40, "depected" should be -- depicted --.
Line 44, "situation" should be deleted.
Line 56, "piston" should be -- deburrer --.
Line 60, "bar" should be -- pusher --.

Column 4,
Line 3, "body (4)" should be -- pistons (4) --.
Line 10, "piston" should be -- deburrer --.

Signed and Sealed this

Sixteenth Day of July, 2002

*Attest:*

*Attesting Officer*

JAMES E. ROGAN
*Director of the United States Patent and Trademark Office*